US009674896B2

(12) United States Patent
Madani et al.

(10) Patent No.: US 9,674,896 B2
(45) Date of Patent: Jun. 6, 2017

(54) ULTRA DENSE AND ULTRA LOW POWER MICROHOTPLATES USING SILICA AEROGEL AND METHOD OF MAKING THE SAME

(71) Applicant: University of Louisiana at Lafayette, Lafayette, LA (US)

(72) Inventors: Mohammad Reza Madani, Lafayette, LA (US); Seyedmohammad Seyedjalaliaghdam, Lafayette, LA (US)

(73) Assignee: The University of Louisiana at Lafayette, Lafayette, LA (US)

( * ) Notice: Subject to any disclaimer, the term of this patent is extended or adjusted under 35 U.S.C. 154(b) by 401 days.

(21) Appl. No.: 14/470,328

(22) Filed: Aug. 27, 2014

(65) Prior Publication Data

US 2015/0201463 A1 Jul. 16, 2015

Related U.S. Application Data

(60) Provisional application No. 61/871,205, filed on Aug. 28, 2013.

(51) Int. Cl.

| | |
|---|---|
| ***B05D 3/12*** | (2006.01) |
| ***B05D 3/00*** | (2006.01) |
| ***H05B 3/10*** | (2006.01) |
| ***B05D 1/00*** | (2006.01) |
| ***H05B 3/22*** | (2006.01) |
| *B05D 5/00* | (2006.01) |

(52) U.S. Cl.

CPC ..... *H05B 3/10* (2013.01); *B05D 1/005* (2013.01); *H05B 3/22* (2013.01); *B05D 3/007* (2013.01); *B05D 5/00* (2013.01)

(58) Field of Classification Search

CPC . H05B 3/10; H05B 3/22; B05D 1/005; B05D 3/007; B05D 5/00

USPC ..... 427/498

See application file for complete search history.

(56) References Cited

U.S. PATENT DOCUMENTS 3,988,824 A * 11/1976 Bodway ..... H01L 21/707 205/125
5,689,151 A * 11/1997 Wallace ..... H01J 7/18 313/481
2012/0180563 A1* 7/2012 Wang ..... G01F 1/692 73/204.26

* cited by examiner

*Primary Examiner* — Kirsten Jolley
(74) *Attorney, Agent, or Firm* — Robert Devin Ricci; Kean Miller LLP

(57) ABSTRACT

An ultra dense and ultra low power microhotplates using silica aerogel and method of making the same, comprising spin coating an aerogel layer followed by $SiO_2$ as capping interlayer, and Nichrome ($Ni_{80}/Cr_{20}$) for heating element to increase the efficiency of metal oxide gas sensors. There may be multiple thin layers of aerogel separated by interlayers such as of $SiO_2$.

1 Claim, 7 Drawing Sheets

Completely Etched Airpit

Remaining Unetched Column

ULTRA DENSE AND ULTRA LOW POWER MICROHOTPLATES USING SILICA AEROGEL AND METHOD OF MAKING THE SAME

CROSS REFERENCE TO RELATED APPLICATIONS

This application claims priority to the provisional U.S. patent application No. 61/871,205 entitled "ULTRA DENSE AND ULTRA LOW POWER MICROHOTPLATES USING SILICA AEROGEL" filed Aug. 28, 2013.

STATEMENT REGARDING FEDERALLY SPONSORED RESEARCH OR DEVELOPMENT

Not Applicable.

REFERENCE TO A "SEQUENCE LISTING," A TABLE, OR A COMPUTER PROGRAM

Not Applicable.

DESCRIPTION OF THE DRAWINGS

The drawings constitute a part of this specification and include exemplary embodiments of the ultra dense and ultra low power microhotplates using silica aerogel and the method of making the ultra dense and ultra low power microhotplates using silica aerogel, which may be embodied in various forms. It is to be understood that in some instances, various aspects of the invention may be shown exaggerated or enlarged to facilitate an understanding of the invention. Therefore the drawings may not be to scale.

FIG. 1A depicts a NiCr heater built on an aerogel. FIG. 1B depicts a heater built on an air pit.

FIG. 4A depicts a fabricated unetched column. FIG. 4B depicts a simulated unetched column.

DETAILED DESCRIPTION

Figure 1A:
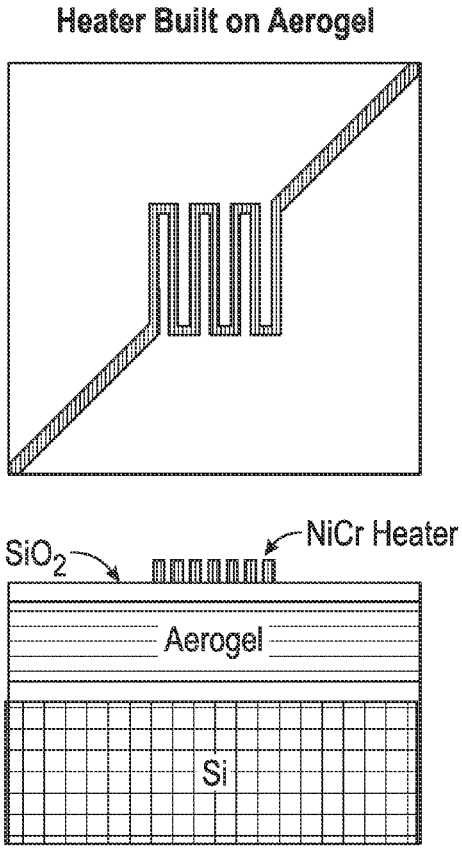
FIGS. 1A and 1B depict schematic structures of heaters for experiment and simulation.

The subject matter of the present invention is described with specificity herein to meet statutory requirements. However, the description itself is not intended to necessarily limit the scope of claims. Rather, the claimed subject matter might be embodied in other ways to include different steps or combinations of steps similar to the ones described in this document, in conjunction with other present or future technologies. Although the terms "step" and/or "block" or "module" etc. might be used herein to connote different components of methods or systems employed, the terms should not be interpreted as implying any particular order among or between various steps herein disclosed unless and except when the order of individual steps is explicitly described.

Furthermore, the described features, structures, or characteristics may be combined in any suitable manner in one or more embodiments. One skilled in the relevant art will recognize, however, that the ultra dense and ultra low power microhotplates using silica aerogel and the method of making the same may be practiced without one or more of the specific details, or with other methods, components, materials, and so forth. In other instances, well-known structures, materials, or operations are not shown or described in detail to avoid obscuring aspects of the invention. Additionally, the order in which a particular method occurs may or may not strictly adhere to the order of the corresponding steps shown.

Metal oxide (also referred to herein as, "MOX") sensors have significant domestic and industrial applications in gas detecting instruments. The main component of the MOX gas sensors is a plate called a microhotplate (also referred to herein as "OP") on which the gas sensing elements are fabricated. The temperature of the sensing elements must be maintained in the range of 300° Celsius to 500° Celsius for efficient gas detection. This demands a highly efficient heater with minimum power consumption, maximum density, and fast response time when utilized in a sensor array. The current approach to achieve the desired temperature is to micromachine the semiconductor substrate to have an air pit acting as a thermal insulator. However, a large area is sacrificed to micromachine the air pit leading to a low density sensor array. It also results in low reliability in detecting because there are a fewer available number of sensors in a given area. The other issue is to minimize the power consumption which is mainly consumed by the μHPs. Previous studies have reported power consumption per unit area of 0.12 to 10 $\mu w/\mu m^2$ to maintain the temperature in the range of 300 to 400° Celsius.

Silica aerogel has gained attention both in research and industrial communities due to its unique properties of ultra-low thermal conductivity, high thermal stability, high specific surface area, etc. Recently there have been several studies on aerogel applications in the various fields including but not limited to capacitive deionization of water aero capacitor due to high surface area of aerogel, and sound absorption in ultrasonic devices. More recently, aerogels have been successfully synthesized in different forms of microspheres, thin films, and flexible sheets among which thin films have received more interest in applications such as ideal dielectrics for ultrafast integrated circuits and heat insulator in gaseous sensors due to the low thermal conductivity of aerogel. Combining it with microelectromechanical systems (also referred to herein as "MEMS") expands the applications of aerogel even more in devices requiring a steady high temperature.

The MOX gas sensors should operate at temperature range of 300° Celsius to 500° Celsius for maximum sensitivity. The sensing material is deposited on a plate called microhotplate. The high operating temperature of MOX gas sensor demands an efficient design to consume low power in order to raise the temperature of OP to desired level as quickly as possible. Various designs and materials have been considered for microhotplate fabrication. Specifically, a microhotplate fabricated with an active surface area of 50×60 $\mu m^2$ wasreported to consume 30 mW power when operating at 350° Celsius. In another article, a circular active surface area of 80 $\mu m^2$ in diameter was developed to operate at higher temperature of 400° Celsius consuming some 8.9 mW only. The latter achieves significant improvement in power efficiency by increasing its pit height to 400 μm based on front side bulk micromachining. However, this power efficiency is at a significant expense of chip area taken by each sensor. By simple calculation one can quickly realize that minimum chip area needed to micromachine such a deep pit would be in order of 566×566 $\mu m^2$, which is 64 times the size of microhotplate itself. As a result, microsensor arrays obtained using such microhotplate design will undoubtedly suffer from a very low sensor density. Briand et al. have reported to make microhotplate gas sensor on a polyimide layer (as etch stop layer) using tedious back micromachining involved in processing air pit microhotplate gas sensors. However, they end up with an effective heated hotplate size of 750×750 $\mu m^2$ andpower consumption of 66 mW to reach the temperature of 325° Celsius while using large area (1.5×1.5 $mm^2$) for backside micromachining. Therefore, we are in urgent need of area efficient gaseous sensor design with low power consumption to present a cost-effective manufacturing of sensor arrays on the wafer.

To overcome the limitation of low density sensor arrays and high power consumption to reach high temperature on microhotplate, we proposed a novel approach of using aerogel as heat insulator rather than using air. The conventional method to insulate the microhotplate from the silicon substrate is to micromachine the silicon (Si) substrate to form an air pit. Wet micromachining is a post processing step, where over etching may occur while masking the sensor and its circuitry due to improper etching time control or pinholes in the masking material. This can reduce the yield and compromise the mechanical stability of the microhotplate. During the fabrications process of OP, Laconte et al. reported broken membranes due to backside micromachining with Tetra Methyl Ammonium Hydroxide (TMAH) etchant, which also damaged aluminum interconnections when masking layers failed. Furthermore, many of those surviving membranes were broken during subsequent deposition of the sensing layer material, photolithography processes, and selective wet etching. Dicing is another cause of the yield loss, since conventional dicing utilizes high water pressure to remove debris from the chip surface.

We previously reported that using relatively thick (40-100 μm) aerogel material instead of air as heat insulator yields the following advantages (1) ultra low power consumption, (2) area-efficient design to support high sensor density, (3) excellent temperature uniformity across the microhotplate surface, (4) low manufacturing costs (due to high yields), (5) high mechanical stability, and (6) fast fabrication. However, processing a thick layer of aerogel of 5 μm or more is extremely difficult using multilayer processing since the spin coating of aerogel is limited to 0.6 to 1.2 μm per layer. In view of the fact that a relatively thick layer of aerogel is required for ultra low power MOX sensors, the step coverage problem for the metal interconnection lines between the sensor array and the CMOS chip circuitry will pose significant yield problem. However, we have demonstrated in this paper that the recessing of the thick aerogel in a selected area of the chip not only resolves the step coverage problem but also avoids tedious and difficult multilayer processing of thick aerogel film. Furthermore, the recessed aerogel processing will not adversely lower the yield caused by post processing of the sensor array.

Using aerogel as a heat insulator yields the following advantages over the micromachined air pit conventionally created as a heat insulator in metal oxide gas sensors: i) superior heat insulation capability hence lower consumed power, ii) more mechanical stability of the sensor by not suspending the sensor structure by four thin straps, iii) a denser sensor array by avoiding micromachining.

In the operation of air pitted gaseous sensors, the microhotplate consumes almost all the power used by the sensor. The required area to micromachine the air pit for the microhotplate of a single sensor is several times more than the actual area required for the sensor itself. In comparison with the conventional air pitted microhotplate structure, the recessed aerogel microhotplate disclosed herein not only has decreased the utilized area of the chip almost tenfold (181×181 $\mu m^2$ vs. 573×573 $\mu m^2$) to maintain a temperature of 360° Celsius, but also has decreased the power consumed by each microhotplate more than two fold (1 mW vs. 2.1 mW). As the number of sensors increases in a sensor array, the saved area of the chip increases quadratic by using the structure disclosed herein. Moreover, the power consumed by the new designed structure reduces drastically.

An example of Single layer aerogels. Thin film aerogels from approximately 0.5 μm to approximately 0.8 μm in thickness are prepared using the following procedure; first a solution was prepared implementing a 2-step sol-gel method by mixing TEOS (Si precursor), ethanol (solvent), water, and HCl (acid catalyst) with the molar ratio of 1:4:4.2:4×$10^{-4}$, respectively. After an hour of stirring the solution, 0.64 ml of $NH_4OH$ 0.06 M (base catalyst) was added and stirred for 5 more minutes. The sol-gel was deposited on the wafer after 60% of gelation time (20 minutes), followed by spin coating at 2000 RPM for 15 seconds. Next, an ethanol exchange was carried out for a period of 24 hours to strengthen the gel network. Finally, the aerogel thin film of 0.5 μm thickness was obtained by supercritical drying the wafer with $CO_2$ followed by annealing at 450° Celsius for an hour.

In one embodiment, thin film Nichrome heaters with good adhesion to aerogel were created by sputtering an interlayer of $SiO_2$ before sputtering NiCr ($Ni_{80}/Cr_{20}$) on the wafer. For CMOS compatibility polycrystalline silicon can be used as heater element. Later, a photolithography procedure was carried out to obtain the desired heater structure shown in FIG. 1*a*.

Figure 1B:
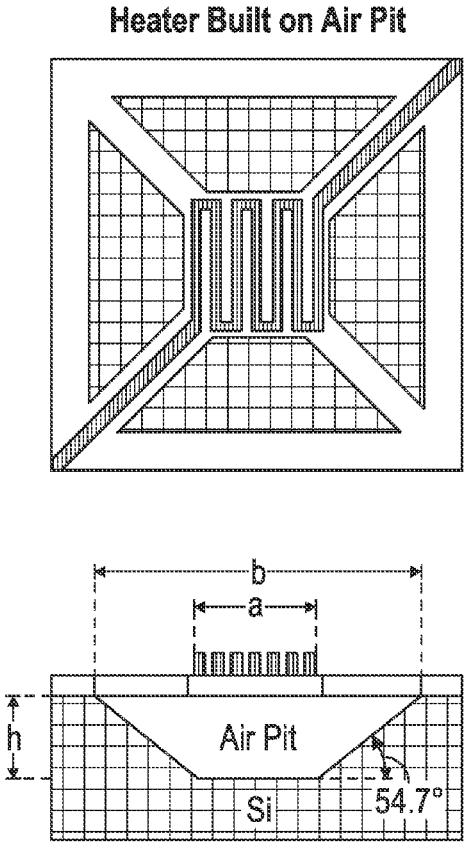
Figure 2:
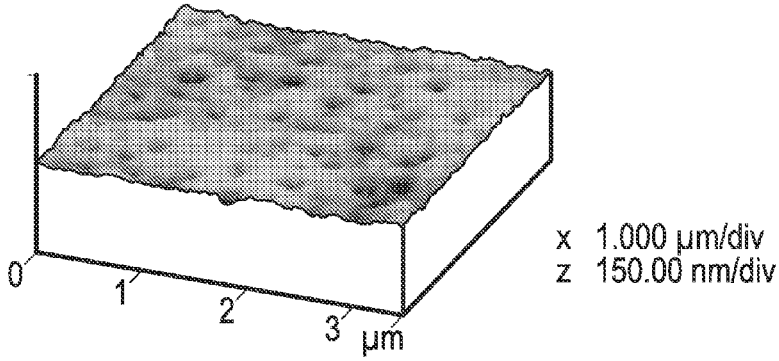
FIG. 2 is an atomic force microscope (AFM) image of the processed porous thin film aerogel.

The schematic structure used in our experiment and simulations are shown in FIG. 1*a*. The simulated air pit structure created by the conventional micromachining is shown in FIG. 1*b*. The atomic force microscope (AFM) image shown in FIG. 2 demonstrates the surface topology of the thin film aerogel. The porous structure can be clearly observed in the image. The root mean square roughness on the surface is as low as 1.33 nm which represents the smooth surface of the aerogel thin film. The extremely low roughness of the thin film enables high quality photolithography and masking. The refractive index and the thickness of the thin film were studied by using a Spectroscopic Reflectometer (SR300) which measured the reflecting light signal from the sample. The refractive index was measured as 1.053 at wavelength 633 nm (FIG. 6), corresponding to the porosity ($\pi$) of 85% using $\pi=1-((n_f-1)/0.209\rho_s)$, where $n_f$ is the refractive index of the aerogel thin film and $\rho_s$ is the density of thermal oxide $SiO_2$ (2.19 g/cm$^3$). Finally, the thickness of the thin film was determined as 807 nm.

To verify the experimental results a thermo-electrical analysis of our designed structures was performed by utilizing a MEMS simulation software, IntelliSuite. The software is equipped with the following modules: IntelliMask to design the mask; 3D Builder to create the meshed solid blocks and differentiate their entities on different layers; TEM (ThermoElectroMechanical) to assign the properties of each entity, load the initial conditions, and simulate the temperature gain by applying voltage to one end of the heater while keeping the other end at zero potential.

The temperature of the heater was measured as a function of the applied electrical power by measuring the change in heater resistance based on the following equation: $\Delta R/R_0=\alpha\Delta T$, where $\alpha$ is the temperature coefficient of resistivity and $R_0$ is the initial resistance of the heater at reference temperature (27° Celsius). There are three major observations with regard to the obtained temperature at different applied powers per unit area, noted in FIG. 3. First is the comparison of the experimentally measured temperature of heaters processed on aerogel and heaters processed on silicon wafer without heat insulation (no aerogel, no air). The excellent ability of aerogel to insulate heat is pronouncedly seen where a good increase of temperature is detected in the case of aerogel coated wafers (0.8 μm) while almost no change in temperature is observed for the wafers without the aerogel, indicating the presence of heat sink in the form of silicon substrate under the heater.

Figure 4A:
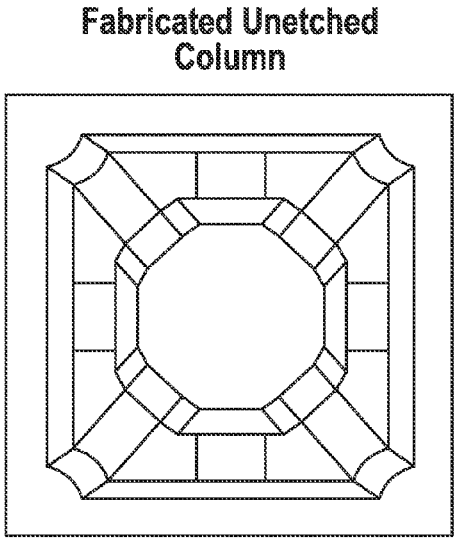
FIGS. 4A and 4B depict trapezoid opening limitations on perfect etching.
Figure 4B:
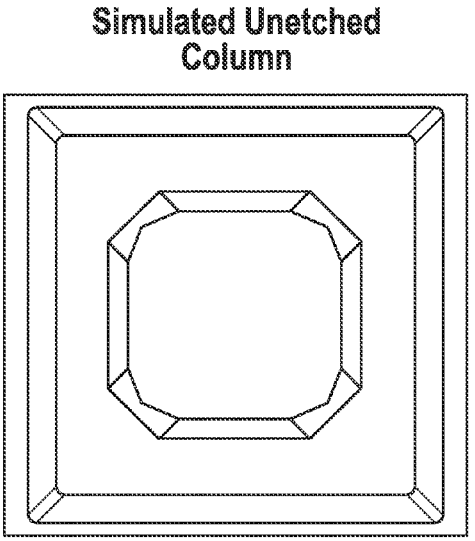

Second, the comparison between the simulation results of aerogel coated wafers and wafers with a micromachined air pit with the same aerogel thickness and air pit depth. Yet again, a better thermal insulation is observed for the aerogel as compared to air due to ultra-low thermal conductivity of aerogel. Although we have simulated an air pit of 0.8 μm depth, it is not possible to micromachine such a shallow pit using the usual trapezoidal shaped mask. In fact, to etch out the silicon from underneath of an a×a hotplate h deep, the required square size opening is: $b=a+(2h/(\tan(54.7°)))$. The etchant will etch the silicon through the opening area of the trapezoid to make the air pit as shown in FIG. 1*b*. However, in order to build the air pit we are limited by the trapezoid openings in micromachining. For instance, up to a certain height h, a column of silicon will remain unetched as demonstrated both by experiment and simulation in FIGS. 4*a* and 4*b*. The unetched silicon column will act as a heat sink between the microhotplate and the substrate preventing the temperature to reach the desired value. In addition, we have previously shown by simulation that for the applied power per unit area of 0.07 μW/μm$^2$ an air pit of 160 μm depth is needed to obtain 360° Celsius compared to an 80 μm thick layer of aerogel.

Moreover, according to the equation $b=a+(2h/(\tan(54.7°)))$, the area of the mask opening or the total occupied area to suspend a single hotplate increases as a square function of the height of the pit. Hence, one can calculate the percentage of saved area as: $S=((b^2-a^2)/a^2)\times100$, which implies that the micromachined air pit for each individual sensor in a sensor array uses much more area of the chip than using aerogel on the wafer for the same array. Hence, a denser sensor array can be fabricated quite easily by using aerogel as compared to a micromachined air pit.

Figure 3:
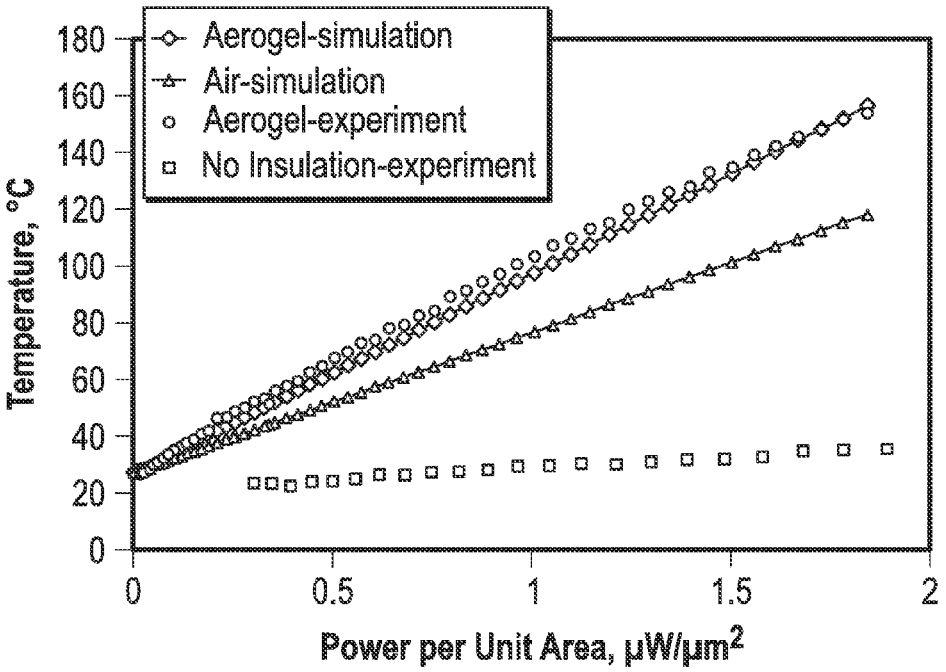
FIG. 3 is a graph depicting the obtained temperature versus power per unit area for 0.8 μm thick aerogel insulation, 0.8 μm deep air insulation, and no insulation.

The last and most significant observation from FIG. 3 is the close match between experimental and simulation results for aerogel coated wafers considering the temperature versus applied power per unit area. For instance, for the applied power per unit area of 1.6 μW/μm$^2$ the measured temperature is 140° C. compared to the simulated temperature of 133° C.

Figures 9A, 9B:
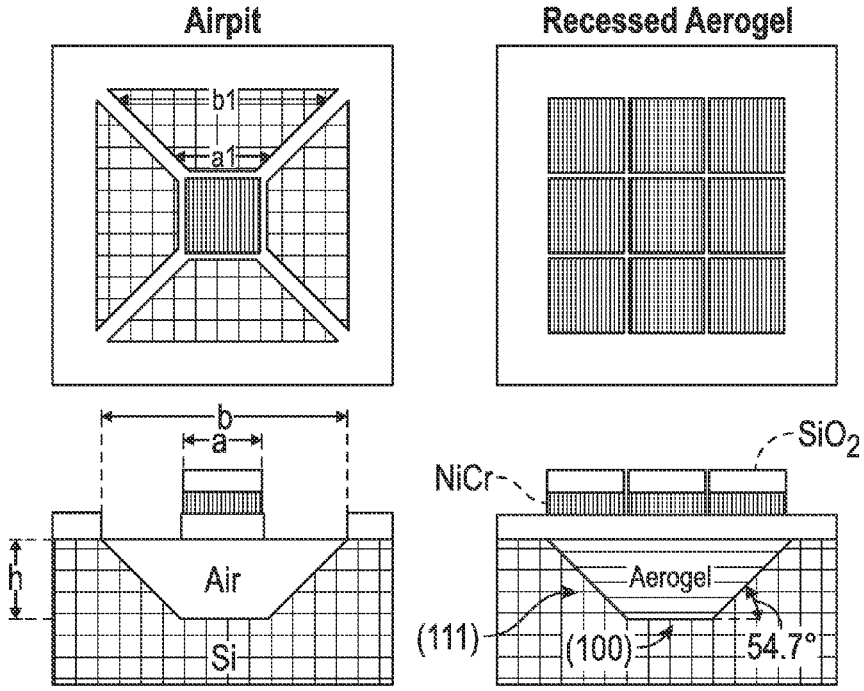
FIG. 9A depicts a schematic of a single microhotplate on an air pit.
FIG. 9B depicts a schematic of an array of microhotplates on recessed aerogel.

Air pit design and chip area considerations. The whole structure of the conventional air pit is made of 3 layers as depicted in FIG. 9(*a*). At the bottom there is a p-type silicon substrate in which an air pit is created to provide thermal insulation. The first layer is a dense 2 μm thick thermally grown $SiO_2$ or $Si_3N_4$ serving as micromachining mask shaped into four suspended bridges for mechanical support of the sensor shown in FIG. 9(*a*). But in the case of aerogel, this layer is a complete layer of $SiO_2$ on top of the aerogel and the thickness can be as low as 0.2 μm as illustrated in FIG. 9(*a*). The second layer is the NiCr ($Ni_{80}/Cr_{20}$) on top of $SiO_2$ which is also 0.2 μm. This layer can be highly doped polysilicon for CMOS process compatibility. Finally, the third layer is an $SiO_2$ layer of 0.6 μm thickness to provide electrical insulation of heater from the sensing layer. It also yields better temperature uniformity across the microhotplate since $SiO_2$ is relatively a good heat conductive material. As reported in our previous study for the non-recessed spin coated thin aerogel, micromachining of the silicon is completely eliminated. Although the thicker aerogel reduces the power drastically, high step coverage decreases the yield severely unless through-aerogel via (TAV) is used to connect the MOX sensor to the CMOS circuitry. We investigated the recessed aerogel with micromachining a large area of silicon for sensor arrays prior to the fabrication of the sensor. Then we filled the anisotropically etched cavity with aerogel.

Anisotropic etching is used to form the cavity underneath the microhotplate of the gas sensor. The etching is called anisotropic since the etching rate is high in the (100) direction and low in the (111) direction as shown in FIG. 9(*b*). The etch rate in the two directions can be different as 300 to 1. In the silicon crystal lattice structure, the (111) planes are oriented at 54.7° relative to the (100) plane (FIG. 9(*b*)). A square mask opening on the surface of the wafer will yield an etched feature in the shape of inverted pyramid at the depth determined by the intersection of (111) plane. To suspend the microhotplate in the air a mask is made with four trapezoids (with dimensions of: $a_1$=short base, $b_1$=long base, and $h_T$=altitude) placed close together from their short bases $a_1$ to form an area of square of a×a where $a=a_1+2\Delta w$ for the microhotplate (FIG. 9(*a*)). The area considered for the hotplate is 181×181 μm$^2$ (a=181). The four long bases of the trapezoids $b_1$ will form the mask opening area of b×b where $b=b_1+2\Delta w$. The four straps that hold the microhotplate suspended in the air after micromachining have the width $w=\sqrt{2}\Delta w$ and the length of straps $I=V(2(b-a))/2$ The thermo-electrical analysis of the disclosed structures is performed by utilizing a MEMS simulation software, IntelliSuite. The software is equipped with the following modules: IntelliMask to design the mask; 3D Builder to create the meshed solid blocks and differentiate their entities on different layers; TEM (ThermoElectroMechanical) to assign the properties of each entity, load the initial conditions, and simulate the temperature gain by applying voltage to one end of the heater, keeping the other end at zero potential; the IntelliEtch will figure out the final shape of micromachined structure by using an etchant like KOH buffer. The temperature at the bottom of the silicon substrate is set to room temperature of 27° Celsius to resemble the reference temperature. Input power can then be calculated by knowing the applied voltage and reading the current density passed through the heater.

To etch out the silicon from underneath of an a×a hotplate h deep, the required square size opening is: $b=a+(2h/(\tan(54.7°)))$.

Figure 10:
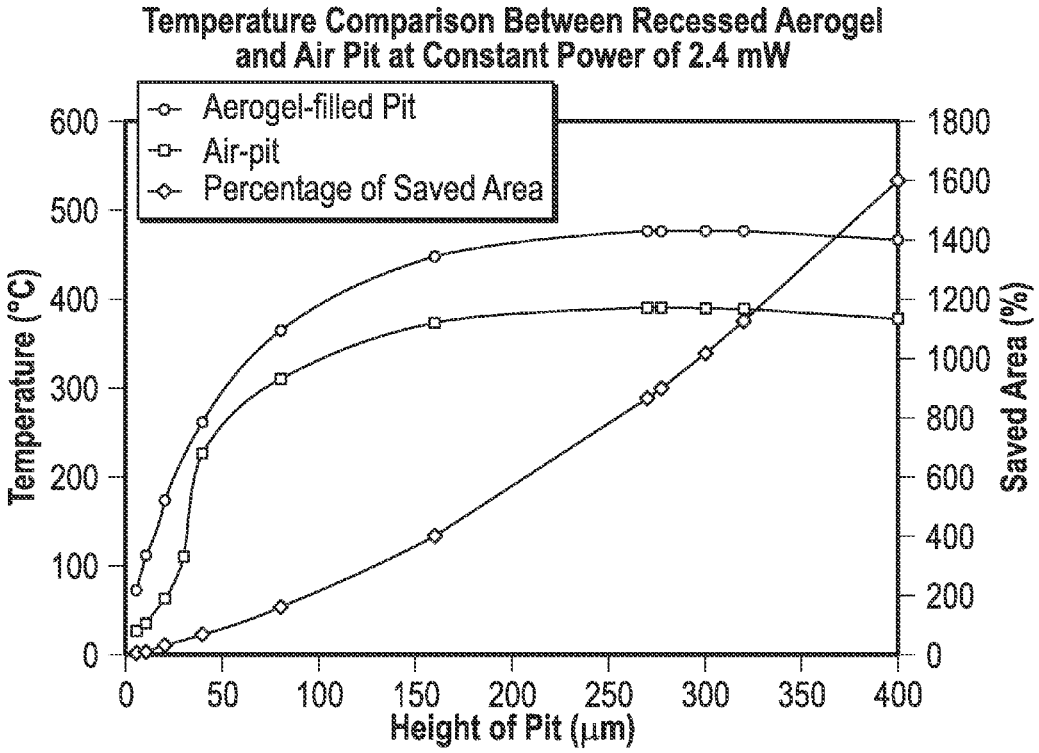
FIG. 10 is a graph depicting the temperature and saved area for different heights of pits.

The etchant will etch the silicon through the opening area of the trapezoid to make the air pit as shown in FIG. 9(*a*). On the other hand, in order to make the pit filled with aerogel there is no need of a trapezoid mask, but a simple square mask would create the pit as illustrated in FIG. 9(*b*). According to the equation: $b=a+(2h/(\tan(54.7°)))$, the area of the mask opening or the total area used increases as a square function of the height of the pit. Hence, one can calculate the percentage of saved area as: $((b^2-a^2)/a^2)\times 100$, which implies that the micromachined air pit for each individual sensor in a sensor array uses much more area of the chip than using aerogel on the wafer for the same array. FIG. 10 demonstrates the percentage of the saved area for different depths of the micromachined pit. For instance, by having a depth of only 160 μm pit filled with aerogel, we can significantly save four times less area than that of our air pit. In another word, for every sensor processed with air pit we can have 5 sensors using aerogel. As the height of the aerogel increases more space would be saved by a parabolic factor. Hence, a denser sensor array can be fabricated quite easily by using aerogel compared to micromachined air pit.

Figure 11A:
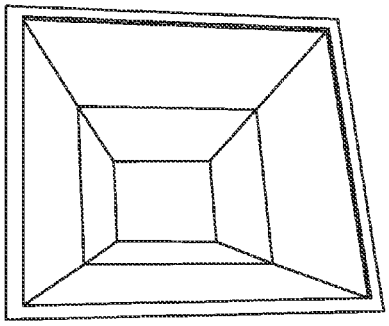
FIG. 11A depicts a 3-dimensional image of a completely etched air pit simulated by IntelliEtch a module of IntelliSuite.
Figure 11B:
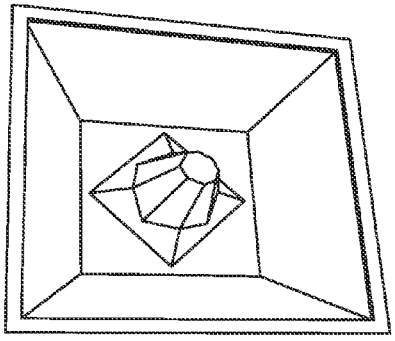
FIG. 11B depicts a 3-dimensional image of a remaining unetched column for an air pit simulated by IntelliEtch a module of IntelliSuite.

Besides, in order to build the conventional air pit we are limited by the trapezoid openings in micromachining. For instance, up to a certain height h, a column of silicon will remain unetched as demonstrated in FIG. 11*b*. The unetched silicon column will act as a heat sink between the OP and the substrate preventing the temperature to reach to the desired value as shown in FIG. 10 for the air pit of height less than 50 μm. However, for the recessed aerogel any desirable size of the pit height is achievable with a simple Manhattan mas opening. Once the pit is filled with aerogel an array of μHPs is processed on top of the recessed aerogel.

Figure 12:
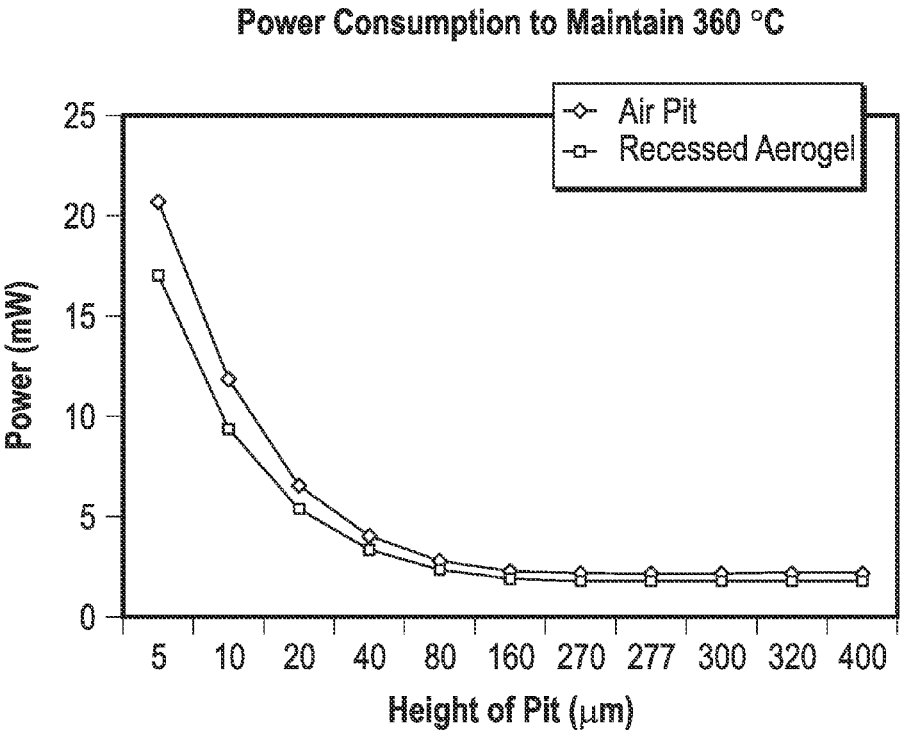
FIG. 12 is a graph depicting the power consumption needed to maintain 360° Celsius when using an air pit or a recessed aerogel.

As shown in FIG. 12, to maintain 360° Celsius the power consumption by OP array reduces exponentially as the height of the recessed aerogel increases. For the height equal and greater than 160 μm the power consumed by sensor array will reach to a minimum value of 2.0 mW.

Figure 13:
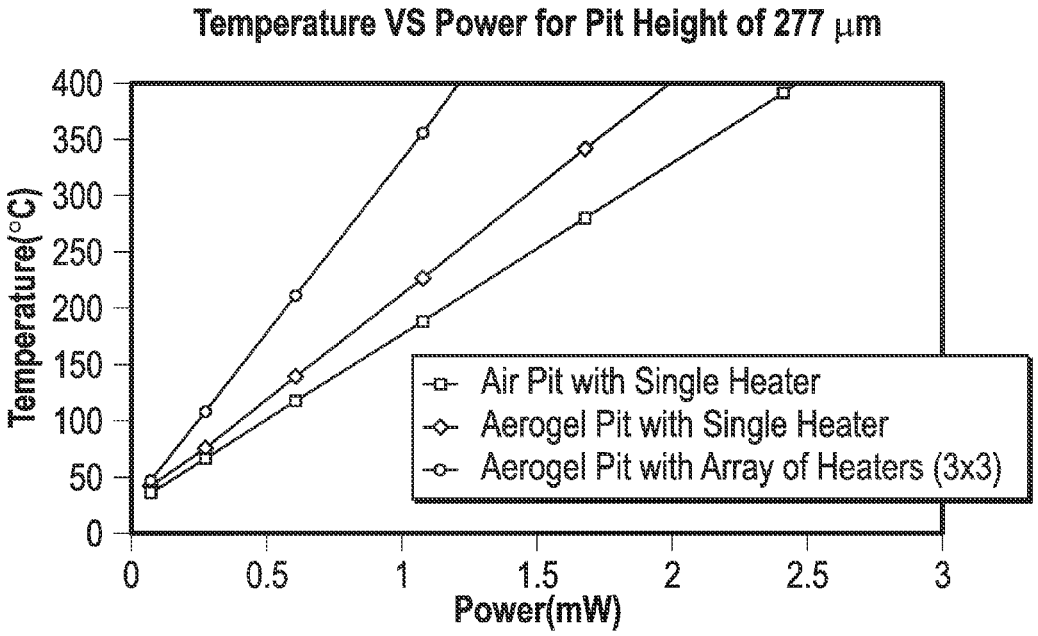
FIG. 13 is a graph depicting temperature versus power for a pit height of 277 μm.
Figure 14A:
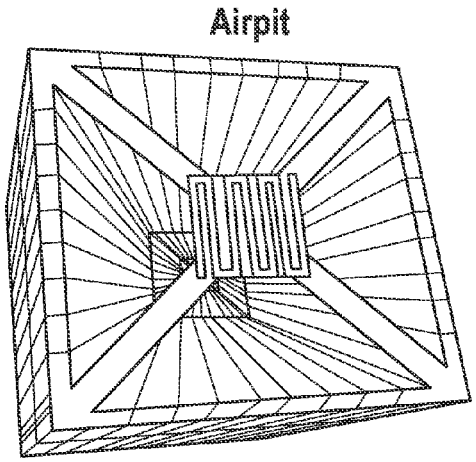
FIG. 14A depicts a 3-dimensional view of an air pit with a single heater.
Figure 14B:
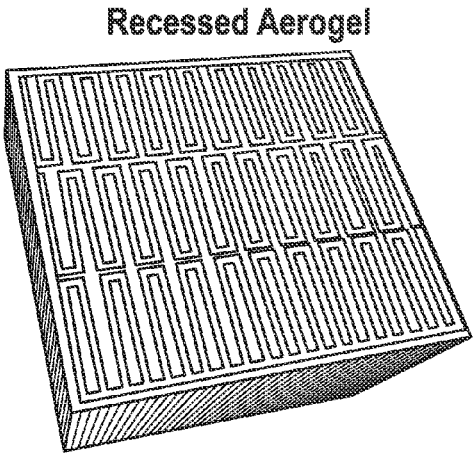
FIG. 14B depicts a 3-dimensional view of a recessed aerogel with an array of heaters (3×3).

In FIG. 13 temperature versus the consumed power per OP is plotted for an air pitted, recessed aerogel, and 3×3 array (573×573 $\mu m^2$) of OP on recessed aerogel. The height of the pit is 277 μm. The power consumed by a OP of an array made on the recessed aerogel gave the best result. In FIG. 10 for applied power of 2.4 mW per heater, the superior heat insulation of recessed aerogel is observed. However, for the air pitted OP that the height is not sufficient to have a large b for a given a according to the equation $b=a+(2h/(\tan(54.7°)))$, the temperature would stay low because of the heat sink path through the unetched column. The two structures depicted in FIG. 14 demonstrate the air pit with single heater (FIG. 14(*a*)) and recessed aerogel with array of heaters (FIG. 14(*b*)).

The recessed aerogel not only improves the efficiency of the microhotplate, but also eliminates the problem of step coverage that can severely reduce the yield of IC-microsensors array chips in manufacturing. The recessed aerogel also has the advantage of micromachining the desired cavity of any size and height prior to fabrication of the sensor arrays.

In addition to the aforementioned advantages of the new structure, the recessed aerogel is shown to have extremely low power consumption, as low as 3 $\mu W/\mu m^2$ for the microhotplate to maintain the temperature at 360° C. and it can also save the area as much as ten times ($2.95\times 10^5$ $\mu m^2$) compared to conventional microhotplate structures.

Figure 5A:
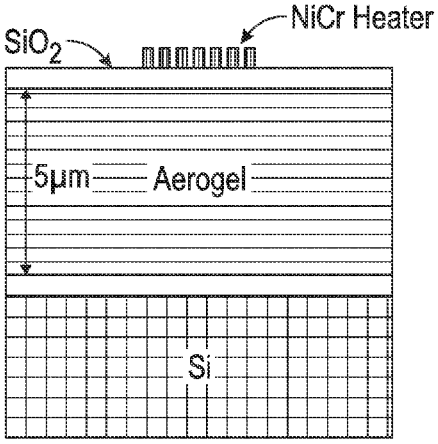
FIG. 5A is a schematic depicting a single thick layer aerogel.
Figure 5B:
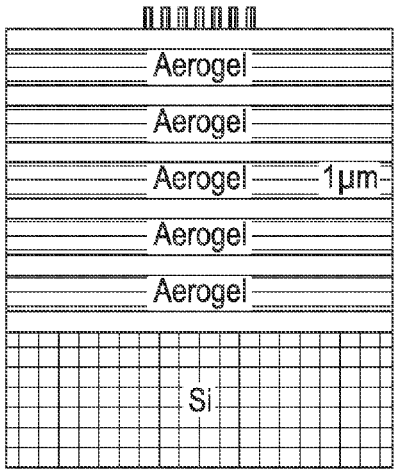
FIG. 5B depicts a proposed multilayer aerogel interleaved with capping layers such as sputtered $SiO_2$.

Multilayer aerogels. In another embodiment, an interlayer thin film $SiO_2$ (200 nm) was sputtered, before processing the next aerogel layer. The sputtered $SiO_2$ covers the porous surface of the aerogel thin film, enabling multilayer aerogel processing as shown schematically in FIG. 5(*b*). The original thin film aerogel layer thickness obtained was approximately 0.5 μm to approximately 0.8 μm which was not sufficient to provide required thermal insulation to achieve high temperature which low power consumption as reported in our previous work. To increase the thickness of the aerogel film another layer was spin-coated on the first layer. However, due to the porous nature of the first aerogel thin film, the second layer penetrated down while spin-coating, resulting in non-uniform surface. Moreover, the penetrated solution fills the pores of the first layer, making it a non-porous dense film. Simulation results indicate sputtering $SiO_2$ between the aerogel layers in formation of multiple layers of aerogel yielded similar thermal performance as the thick multilayer aerogel without using $SiO_2$.

Figure 6:
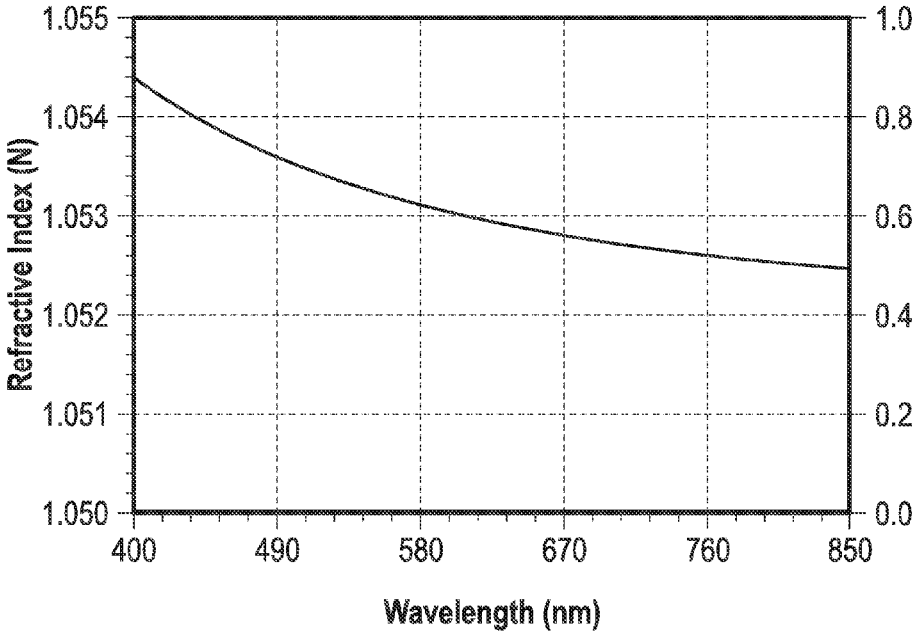
FIG. 6 is a graph depicting the refractive index of the thin film aerogel measured by spectroscopic reflectometer at different wavelengths.

The obtained thin film aerogel was characterized with atomic force microscope (AFM) and spectroscopic reflectometer (SR300) to study the surface topology and measure the thickness of the thin film, respectively. The thickness of each thin film aerogel layer was measured as 800 nm. The refractive index was also determined by spectroscopic reflectometer (SR300) as low as 1.053 at wavelength 633 nm as shown in FIG. 6. The porosity (n) of a thin film is related to its refractive index according to the following equation: $\pi=1-((n_f-1)/0.209\rho_s)$, where $n_f$ is the refractive index of the aerogel thin film and p, is the density of thermal oxide $SiO_2$ (2.19 $g/cm^3$). The corresponding porosity was determined as 85%. This high porosity ensures excellent thermal insulation.

The performance of the multilayer aerogel (five layers of 1 μm each, interleaved with sputtered $SiO_2$) and the thick single layer aerogel (5 μm) was investigated by simulation using the thermo-electrical module of IntelliSuite software. The software is equipped with different modules of: IntelliMask to design the mask; 3D Builder to create the meshed solid blocks and differentiate their entities on different layers; TEM (Thermo Electro Mechanical) to assign the properties of each entity, load the initial conditions, and simulate the temperature gain by applying voltage to one end of the heater, keeping the other end at zero potential. The temperature at the bottom of the silicon substrate is set to room temperature of 27° Celsius to resemble the reference temperature.

Figure 7:
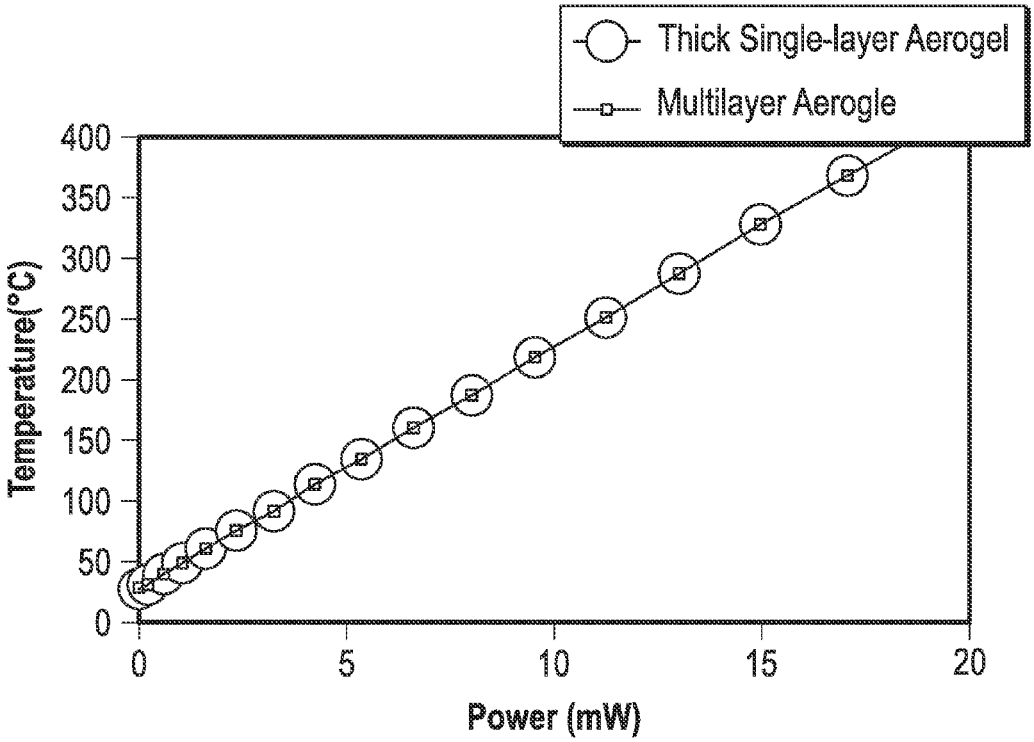
FIG. 7 is a graph comparing the temperature for single and multilayer aerogel in steady state mode.

A steady state analysis was performed for both single and multilayer aerogel to investigate the temperature gain versus consumed power. As demonstrated in FIG. 7, both structures achieved the same temperature at any given power. For instance, applying 15 mW power corresponds to the temperature of 320° Celsius. This promises multilayer processing with the advantage of having $SiO_2$ to cap the bottom aerogel layer avoiding the penetration of the above aerogel, and meanwhile no temperature loss due to utilizing the $SiO_2$ interlayer which itself is a very good heat conductor.

Figure 8:
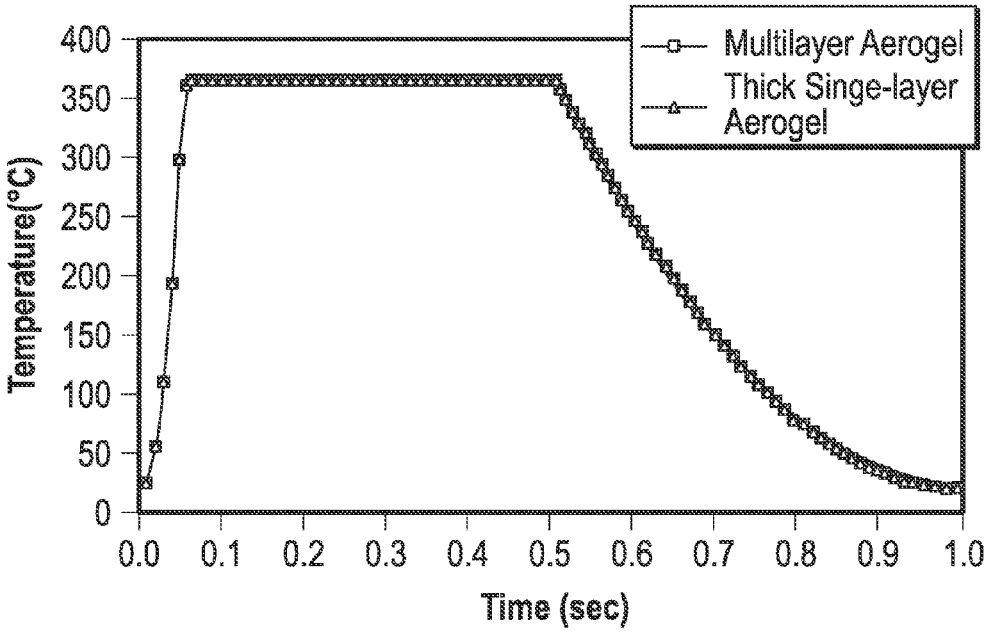
FIG. 8 is a graph depicting the transient analysis of single and multilayer aerogel.

Transient analysis was also conducted over a period of 1 second to investigate the required amount of time to reach the steady state temperature. As demonstrated in FIG. 8, it took 70 ms for both structures to reach steady temperature of 360° Celsius, which again verifies the capability of the interleaved multilayer aerogel to reach high temperature as fast as the thick single layer aerogel.

For the purpose of understanding the ultra dense and ultra low power microhotplates using silica aerogel and the method of making the same, references are made in the text to exemplary embodiments of an ultra dense and ultra low power microhotplates using silica aerogel and the method of making the same, only some of which are described herein. It should be understood that no limitations on the scope of the invention are intended by describing these exemplary embodiments. One of ordinary skill in the art will readily appreciate that alternate but functionally equivalent components, materials, designs, and equipment may be used. The inclusion of additional elements may be deemed readily apparent and obvious to one of ordinary skill in the art. Specific elements disclosed herein are not to be interpreted as limiting, but rather as a basis for the claims and as a representative basis for teaching one of ordinary skill in the art to employ the present invention.

Reference throughout this specification to features, advantages, or similar language does not imply that all of the features and advantages that may be realized should be or are in any single embodiment. Rather, language referring to the features and advantages is understood to mean that a specific feature, advantage, or characteristic described in connection with an embodiment is included in at least one embodiment. Thus, discussion of the features and advantages, and similar language, throughout this specification may, but do not necessarily, refer to the same embodiment.

Furthermore, the described features, advantages, and characteristics may be combined in any suitable manner in one or more embodiments. One skilled in the relevant art will recognize that the ultra dense and ultra low power microhotplates using silica aerogel and method of making the same may be practiced without one or more of the specific features or advantages of a particular embodiment. In other instances, additional features and advantages may be recognized in certain embodiments that may not be present in all embodiments.

Reference throughout this specification to "one embodiment," "an embodiment," or similar language means that a particular feature, structure, or characteristic described in connection with the embodiment is included in at least one embodiment. Thus, appearances of the phrases "in one embodiment," "in an embodiment," and similar language throughout this specification may, but do not necessarily, all refer to the same embodiment.

It should be understood that the drawings are not necessarily to scale; instead, emphasis has been placed upon illustrating the principles of the invention. In addition, in the embodiments depicted herein, like reference numerals in the various drawings refer to identical or near identical structural elements.

It should be understood that the word "aerogel" may also refer to aerogel that can be processed by any varient processing methods and characteristics.

Moreover, the terms "substantially" or "approximately" as used herein may be applied to modify any quantitative representation that could permissibly vary without resulting in a change to the basic function to which it is related.

The invention claimed is:

1. A method of making silica aerogel thin and thick films comprising:

a. mixing tetraethyl orthosilicate, ethanol, water and HCl with the molar ratio of approximately $1:4:2:4.3\times10^{-4}$, respectively to form a first solution;
b. stirring said first solution for approximately one hour;
c. adding approximately 0.64 ml. of 0.066 M $NH_4OH$ to create a second solution;
d. stirring said second solution for approximately 5 minutes to create a sol-gel mixture;
e. aspirating the sol-gel mixture with an aspirator at approximately 15% of gelation time;
f. spraying said the sol-gel mixture onto a column of ethanol to create an impregnated ethanol mixture;
g. aging said impregnated ethanol mixture at room temperature for approximately 24 hours;
h. ultrasounding said impregnated ethanol mixture for approximately 8 minutes;
i. filtering said impregnated ethanol mixture with a 0.2 micrometer filter, resulting in a filtered impregnated ethanol mixture; and
j. spin coating said filtered impregnated ethanol mixture onto the wafer for 40 seconds at approximately 1150 RPM, creating a first aerogel layer.

* * * * *